United States Patent [19]

Ibel

[11] 4,207,628

[45] Jun. 17, 1980

[54] COMBINATION TOILET SEAT AND BIDET BASIN

[76] Inventor: Manfred Ibel, 178 Fifth Ave., New York, N.Y. 10010

[21] Appl. No.: 922,492

[22] Filed: Jul. 6, 1978

[51] Int. Cl.[2] ..... A47K 3/22; A47K 11/08

[52] U.S. Cl. ..... 4/445; 4/234; 4/235; 4/236; 4/240; 4/420.3

[58] Field of Search ..... 4/6, 7, 240, 237, 238, 4/234, 112, 235, 239, 236

[56] References Cited

U.S. PATENT DOCUMENTS

| | | | |
|---|---|---|---|
| 1,505,048 | 8/1924 | McLeod | 4/6 UX |
| 2,036,984 | 4/1936 | Salvoni | 4/6 |
| 2,075,830 | 4/1937 | Salvoni | 4/6 |
| 3,034,137 | 5/1962 | Glou | 4/6 |
| 3,246,344 | 4/1966 | Saulson | 4/112 |
| 3,786,522 | 1/1974 | Kira et al. | 4/237 |
| 3,947,898 | 4/1976 | Ducharme | 4/6 |
| 4,048,679 | 9/1977 | Garnet | 4/237 |

*Primary Examiner*—Henry K. Artis

[57] ABSTRACT

A toilet seat and an overlying bidet basin replacing the toilet seat cover. The toilet seat has enlarged inward sloping opposite middle portions for the supportive engagement of the user's thighs and an opening including enlarged front and rear portions and a relatively narrow middle portion. The lack of any support areas in the front and rear portions of the seat in combination with the inwardly sloped configuration of the enlarged opposite middle portions positions the user into a semi-squat position, thighs and buttocks spread apart, legs angled upwardly, body bent forward at the waist, over the middle portion of a toilet bowl. The enlarged front and rear portions of the opening allow the insertion of the hand for blotting and wiping and prevent soiling. The bidet basin is pivoted down over and into the toilet seat and is consisting of a bidet seat portion which overlies the toilet seat and a bidet bowl portion which penetrates and covers the opening of the seat. The bidet seat portion has enlarged opposite middle portions for the support of the user's thighs, the user straddling the bidet basin facing to the rear with the perineum and genitals suspended over the front and middle portion of the bidet bowl portion. The human seat is situated over an enlarged front portion of the bidet seat opening and an enlarged rear portion of the opening is for the insertion of the hands for washing and rinsing purposes.

11 Claims, 26 Drawing Figures

COMBINATION TOILET SEAT AND BIDET BASIN

BACKGROUND OF THE INVENTION

1. Field of the Invention

The present invention relates to toilet seats and bidet basins, and more particularly to a toilet seat and a toilet seat cover and a bidet basin to be permanently installed by the consumer at his own option in lieu of the toilet seat cover.

2. Discussion of Prior Art

In co-pending patent applications, entitled COMBINATION WATER CLOSET AND BIDET, Ser. Nos. 774,012; 774,016; filed on Mar. 3, 1977, I have described a water closet and a bidet both adapted to each other into a composite and unified structure. I have described therein how all the different parts and components of the unified structure mate and interrelate in harmony without the use of technical gadgetry as in other related inventions. However, the toilet seat and overlying bidet basin of my invention have not been described and illustrated in detail in said applications. I have become aware that my invention needs additional patent protection. Also, certain features and details of my invention, in particular the structure of the toilet seat have developed still further, as will be illustrated below.

This particular application for a patent relates to the unique shape of a toilet seat which also allows a uniquely shaped full-sized bidet basin to overlie and penetrate said toilet seat. Present day toilet seats do not have openings large enough to receive a full-sized bidet bowl. The patents issued to Ippolito Salvoni, mentioned later, give ample proof of this fact. The problem arises from the different requirements and specifications for a toilet seat and a bidet bowl as related to human anatomy and the functions of elimination on one hand compared with washing and rinsing of perineum and genitals on the other. The opening in a bidet basin has to be wide enough in the area of the human seat to allow a certain portion of the buttocks surrounding the ischial tuberosities to be somewhat received; the opening in a bidet basin has to be long enough to give room for perineum and genitals, measuring an average distance of 6–12 inches, and additional space has to be provided for the insertion of the user's hand during washing and rinsing. A toilet seat should be dimensioned to comfortably suspend the perineum over a toilet bowl for the purpose of elimination. If the opposite support areas for the thighs are spaced too far apart, as far apart as required for the human seat in a bidet basin, the toilet seat becomes very uncomfortable. For this reason the conventional toilet seat has a relatively narrow seat opening. Conventional toilet seats and full-sized bidet bowls are obviously not compatible. The toilet seat of my invention is unique in that its only support areas for the thighs of the seated user are located in the middle portion of the seat; the front and rear portions of the seat have enlarged openings and no support areas for the thighs. The overlying bidet basin has matching enlarged front and rear portions. The front portion is large enough to receive a certain portion of the human seat surrounding the ischial tuberosities, the rear portion is wide and long enough for the insertion of the user's hands during washing and rinsing. The middle portion of the bidet basin is for the support of the user's thighs, the user straddling said bidet basin.

Conventional toilet seats are small and also ill-fitted for easy and hygienic defecation and urination. Even the elongated conventional seat barely gives adequate clearance lengthwise for perineum and genitals of the average user. To make it worse, the conventional seat positions the thighs of the user relatively parallel to each other and parallel to the horizontal plane of the toilet seat thus making defecation most difficult. A critical investigation and analytical discussion of the conventional toilet seat and requirements related to elimination and personal hygiene are to be found in Alexander Kira's book, *The Bathroom.*

Prior art toilet seat constructions have offered new shapes for replacement of the conventional toilet seat. One group, including U.S. Pat. Nos. 807,305; 1,163,149; Des. 222,965; Des. 226,912; 3,786,522; features a rear portion of the seat being sloped upwardly and rising above the normal surface of the seat to prevent the user to sit or lean backwards, urging him to bend forward at the waist. In addition, U.S. Pat. No. 3,786,522 encourages the user to spread the legs by making it uncomfortable to rest the thighs on a ridge detail on the inner sides of opposite front portions of the seat. U.S. Pat. No. 2,099,118 puts the user into a "squatting position" by featuring a seat structure of a curved or bowed construction. U.S. Pat. No. Des. 222,466 has enlarged inwardly sloped opposite middle and front portions for supportive engagement of the user's thighs in the front portion of the seat with an enlarged rear portion and an oblong narrow front portion of its opening. This construction angles the legs upwardly and locates the perineum at a lower elevation than the outer peripheral edge surface areas of the seat.

Toilet paper is inadequate for cleaning the anus and perineum after elimination. Water is the natural, easiest and best means to accomplish this. U.S. Pat. No. 3,879,769 has incorporated water sprays into the toilet seat. The user remains seated while a spray from below is activated. This construction and others, which introduce the water spray from a point outside the toilet seat structure, do not give the benefits of a bidet bowl which is a wash basin fitted under the perineum. The conventional toilet seat is ill-fitted for the purpose of defecation, it is worse yet for the purpose of rinsing the perineum from below. The underside of the seat gets wetted and soiled, water is spilled on the floor, the thighs are not placed in a proper straddling position as over a bidet bowl.

The bidet basin is the proper washbowl for rinsing and washing of the perineum and genitals, not the toilet bowl. The user straddles the bidet basin facing the rear where water controls are conveniently located, controlling water temperature and water flow with one hand and using the other hand for rinsing and washing the perineum and/or genitals. Bidet basins are also widely used for sitzbath purposes. In the average bathroom there is just no room provided for an additional bidet fixture. Space and cost saving factors in combination with poorly conceived and engineered detailing of present day bidets made of vitreous china which is cold to the touch of human skin have not helped to make the bidet a popular item in the average bathroom.

The concept of combining a bidet basin with a toilet is relatively old. Quite a few prior art constructions have been patented in the past. One type: a portable bidet basin for temporary positioning over a toilet bowl or toilet seat is shown in U.S. Pat. Nos. 2,947,994; 3,072,918; 3,490,079; 3,577,567; 3,654,636. Other prior art constructions illustrate a permanent arrangement of a bidet basin adapted for use with a toilet as for example in U.S. Pat. Nos. 1,348,518; 1,612,665; and a number of patents issued to Ippolito Salvoni, including U.S. Pat. Nos. 2,036,984; 2,036,985; 2,070,622; 2,075,061; 2,080,438; 2,104,210. In almost all these constructions the bidet basin has been adapted to fit into or over existing toilets or toilet seats. Almost all of these structures have in common that only one partner of the union, the bidet basin, including hardware and technical apparatus for pivotal and water supply connections, has been adapted, the toilet seat or the toilet itself has not. Obviously, these structures are limited to the shape of the toilet and the usual toilet seat, ill-fitted to receive a bidet bowl as discussed above; therefore they have not become popular or commercially available.

Accordingly, it is an object of the present invention to provide a more functional toilet seat and a seat cover wherein the toilet seat has been adapted to receive an overlying full-sized adapted bidet basin to replace the seat cover at the sole option of the consumer.

Another object of my invention is to provide a toilet seat engineered according to human specifications for easy defecation in the semi-squat position, a seat which also allows for a full-sized adapted bidet basin to overly its seat portion and penetrate its opening.

Another object of my invention is to provide a full-sized bidet basin which has been engineered according to human specifications: to fit comfortably under the human seat and perineum, to provide a water seal against the underside of the buttocks, to give ample support surfaces for the thighs, to spread the thighs and buttocks properly, to allow for the insertion of the hands, to provide for proper clearances, drainage, water supply, etc., and also to be adapted to fit over and into an adapted toilet seat.

Yet another object of my invention is to provide a toilet seat and a bidet basin, both being adapted to each other in a mating and interrelating relationship.

Yet another object of my invention is to provide a toilet seat and a bidet basin, both engineered according to optimal hygienic conditions required for defecation, urination and for personal hygiene after elimination and for general perineal hygiene.

Yet another object of my invention is to provide a bidet basin, which can be purchased by the consumer to permanently replace the toilet seat cover of an adapted toilet seat which has been purchased at an earlier time together with a new toilet, thus allowing the average person with an average-sized bathroom, in the home or apartment, the benefits of personal hygiene of a bidet basin at a small additional and optional cost over the cost of a new toilet.

SUMMARY OF THE INVENTION

In accordance with an aspect of the present invention the combination toilet seat and bidet basin in lieu of a toilet seat cover includes a toilet seat, a toilet seat cover and a bidet basin. The toilet seat, seat cover and bidet basin have generally complementary peripheral configurations. The toilet seat has enlarged inwardly sloped opposite middle portions for the supportive engagement of the user's thighs, spreading the thighs and buttocks and angling the legs upwardly. An enlarged rear portion of the toilet seat opening and lack of support surfaces in the rear portion of the seat induces the user to bend forward at the waist for proper balance, thus the user being positioned in the semi-squat position over the middle portion of a toilet bowl for easy and hygienic defecation. The bidet basin, to be pivoted down over and into the toilet seat instead of the toilet seat cover which it replaces, has a bidet seat portion and a bidet bowl portion. The bidet seat portion has an opening of a generally similar configuration to the toilet seat opening below, except in the front portion when an open-front type toilet seat is used, including enlarged opposite middle portions for the supportive engagement of the user's thighs, the user seated straddling the bidet basin facing to the rear. The bidet bowl portion has an upper edge which is integrally attached to the inner peripheral edge of the bidet seat portion, thus penetrating and covering the opening of the underlying toilet seat.

BRIEF DESCRIPTION OF THE DRAWINGS

The above and other objects, features and advantages of my invention will be apparent in the following detailed description of an illustrative embodiment thereof, which is to be read in connection with the accompanying drawings, wherein.

DETAILED DESCRIPTION OF THE INVENTION

Figure 1:
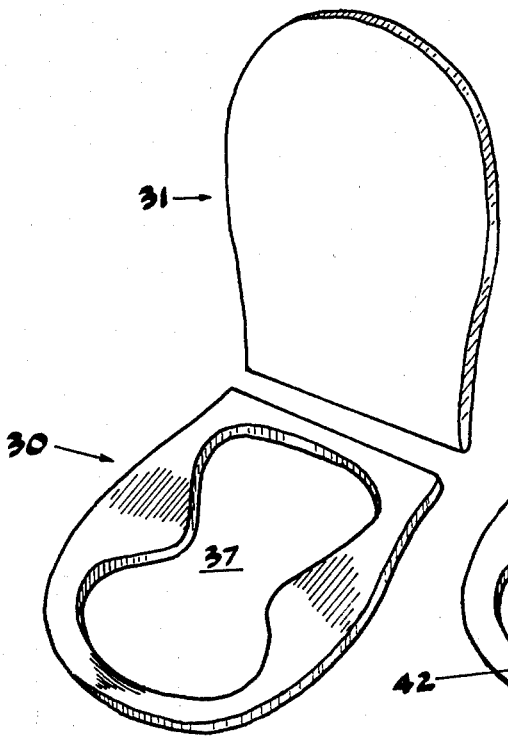
FIG. 1 is a front perspective view of a toilet seat and seat cover constructed in accordance with the present invention.
Figure 1A:
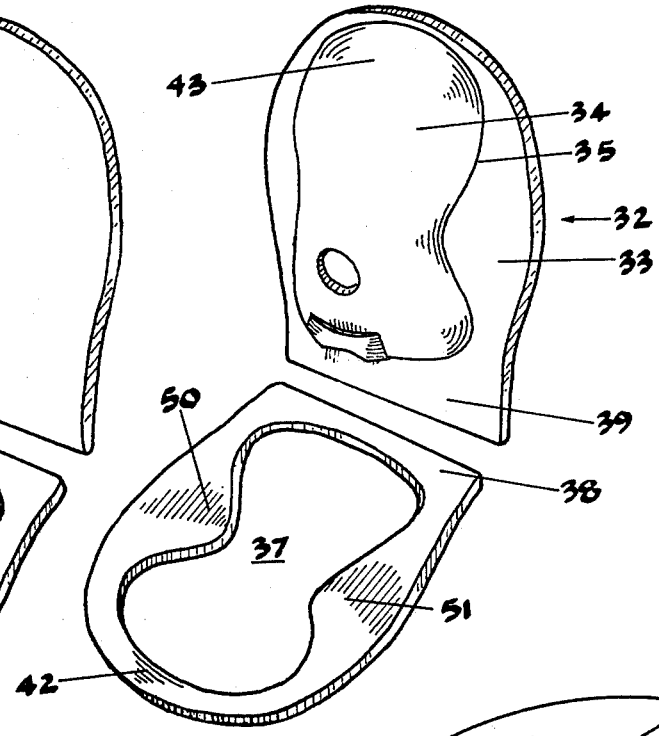
FIG. 1A is a front perspective view corresponding to FIG. 1 with the seat cover replaced by a matching bidet basin.
Figure 5:
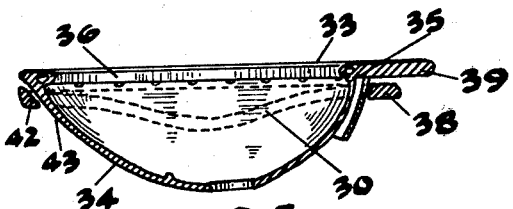
FIG. 5 is a cross-sectional view of FIG. 3 taken along lines 5—5.
Figure 4:
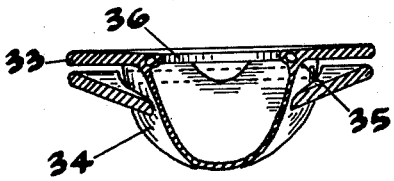
FIG. 4 is a cross-sectional view corresponding to FIG. 3 taken along lines 4—4.
Figure 6:
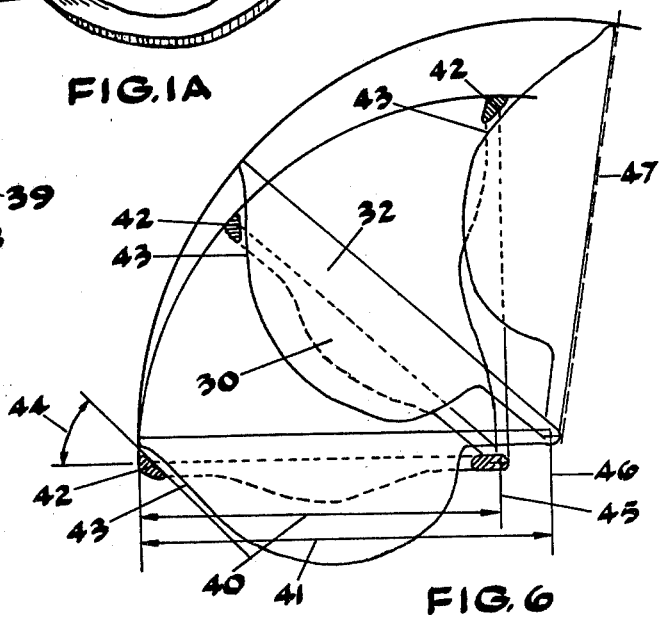
FIG. 6 is a diagrammatic cross-sectional view of FIG. 3 taken along lines 5—5 illustrating simultaneous upward and downward movement of toilet seat and bidet basin.
Figure 2:
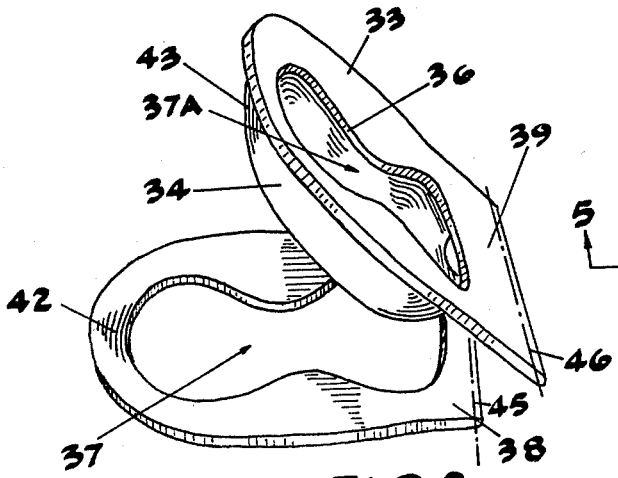
FIG. 2 is a side perspective view corresponding to FIG. 1A illustrating the bidet basin in a partially lowered position.
Figure 3:
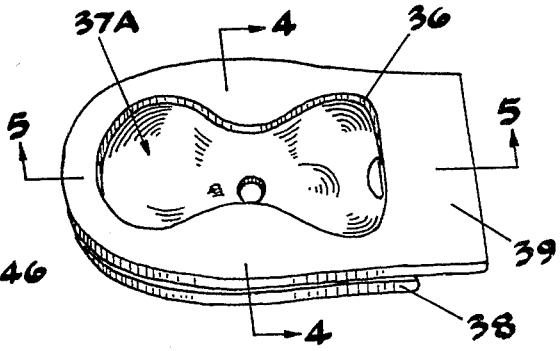
FIG. 3 is a side perspective view corresponding to FIG. 1A with the bidet basin in the down-position.
Figure 7:
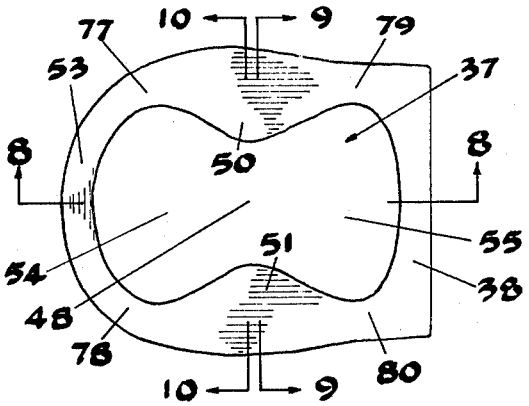
FIG. 7 is a plan view of the toilet seat illustrated in FIG. 1.

As seen in the perspective view of FIGS. 1-1A, toilet seat 30 is provided with a seat cover 31 and a bidet basin 32 to replace the seat cover permanently at the option of the user. Referring now to FIGS. 2-6, bidet basin 32 is shown overlying toilet seat 30. Bidet basin 32 consists of a bidet seat portion 33 and a bidet bowl portion 34 being integrally connected along its upper edge 35 to the inner peripheral edge 36 of bidet seat portion 33. Toilet seat 30 and bidet seat portion 33 have generally similar configurations in plan with similar openings 37,37A with the bidet bowl portion penetrating and covering toilet seat opening 37. Toilet seat 30 and bidet seat portion 33 both have rear end portions 38,39 for pivotal connection to a toilet. FIGS. 2,3,5,6 illustrate one particular embodiment of the rear end portions 38,39 wherein rear end portion 39 of bidet seat portion 33 extends a certain distance beyond rear edge portion 38 and has a pivot axis 46 located rearwardly from the pivot axis 45 of toilet seat 30 permitting bidet basin 32 to be pivoted upwardly and rearwardly out of the way of opening 37 of toilet seat 30 as illustrated in FIGS. 2,6. Turning radius 40 about pivot axis 45 of toilet seat 30 is shorter than pivotal turning radius 41 about pivot axis 46 of bidet seat portion 33. The upper inner front edge 42 of seat 30 has a tendency to jam into the contact surface 43 of bidet bowl portion 34 during simultaneous upward or downward movement of toilet seat and bidet seat portion. To prevent this jamming the contact surfaces 42,43 are contoured parallel to each other with angle 44 not greater than 45 degrees with respect to the normal plane of toilet seat 30 to allow for sliding of edge 42 along contact surface 43. This particular detail is only required when pivotal axes 45,46 have been shifted and when a closed-front type toilet seat is used.

Figure 8:
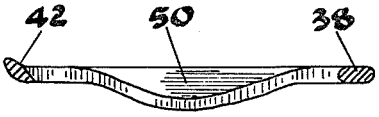
FIG. 8 is a cross-sectional view taken along lines 8—8 of FIG. 7.
Figure 9:
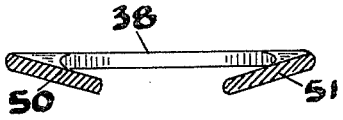
FIG. 9 is a cross-sectional view taken along lines 9—9 of FIG. 7.
Figure 7A:
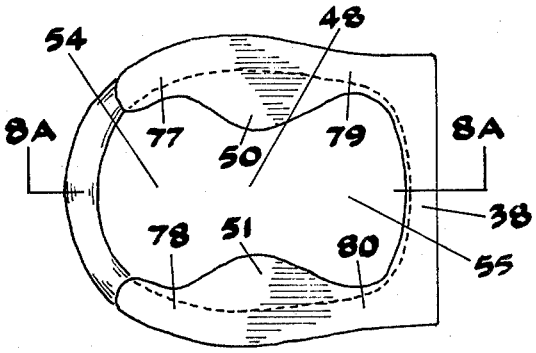
FIG. 7A is a plan view of the toilet seat of FIG. 1 showing an open-front type version of the seat.
Figure 8A:
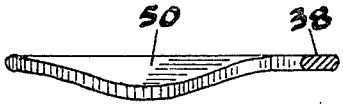
FIG. 8A is a cross-sectional view taken along lines 8A—8A of FIG. 7A.
Figure 10:
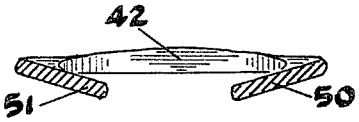
FIG. 10 is a cross-sectional view taken along lines 10—10 of FIG. 7.
Figure 11:
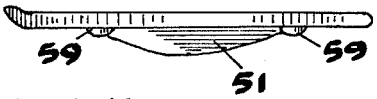
FIG. 11 is a side elevational view corresponding to FIG. 7.
Figure 12:
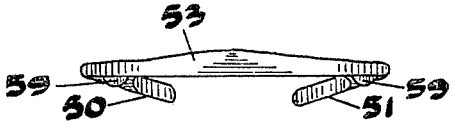
FIG. 12 is a front elevational view corresponding to FIG. 7.
Figure 13:
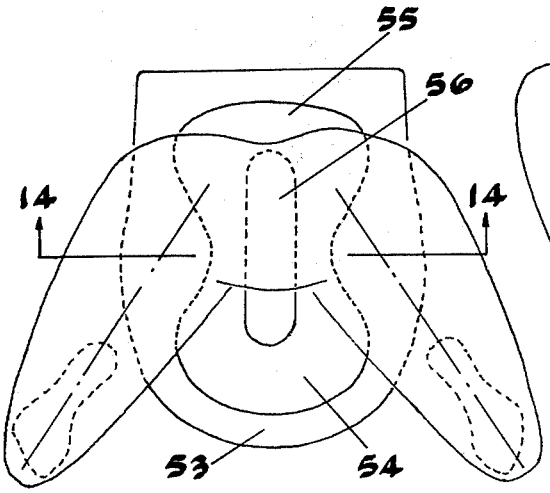
FIG. 13 is a diagramatic plan view illustrating a person seated on the toilet seat of FIG. 7.
Figure 14:
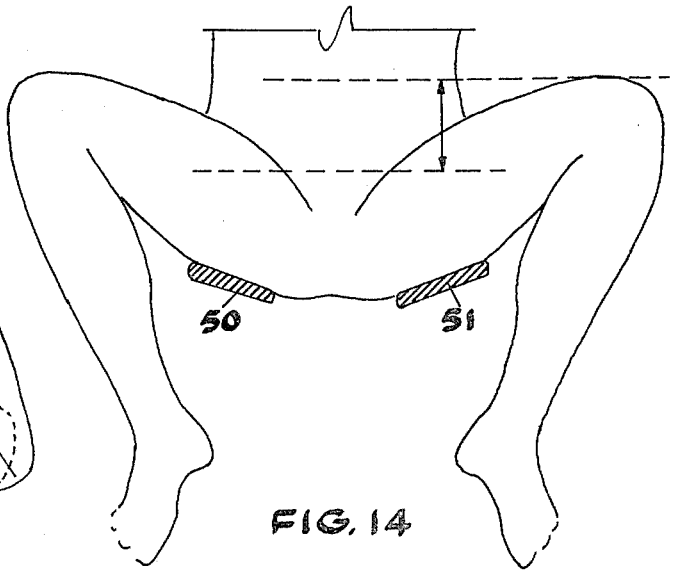
FIG. 14 is a combined cross-sectional and front elevational view taken along lines 14—14 of FIG. 13.
Figure 15:
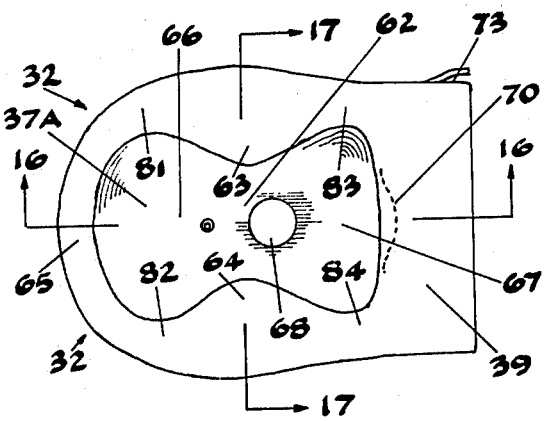
FIG. 15 is a plan view of the bidet basin as illustrated in FIG. 1A.

Referring now to FIGS. 7-14, toilet seat 30 of FIG. 1 is shown with opening 37 having an approximate figure-8-shape configuration, defined by enlarged inwardly extended and inwardly sloped opposite middle portions 50,51 provided for the support of the user's thighs and defined by relatively narrow opposite front surface areas 77,78 and by relatively narrow opposite rear surface areas 79,80. FIG. 7A shows the same structure with an open front wherein the underlying toilet bowl rim completes the image of the approximate Figure-8-shape configuration. The inwardly-sloped enlarged middle portions 50,51 define a relatively narrow middle portion 48 of opening 37 and follow the angle of the seated user's thighs in the semi-squat position placing the knees above the hip joints, as illustrated in FIG. 14. The enlarged front portion 54 and enlarged rear portion 55 of opening 37 provide extra space adjacent to the area 56 of perineum and genitals of the user to prevent soiling of the seat and to allow for the insertion of the hand for wiping and blotting purposes, as shown in FIG. 13. Enlarged rear portion 55 also prevents the user to sit further backwards. The lack of any support surfaces in the rear induces the user to bend forward at the waist for proper balance. The lack of any support surfaces in the front portion of the seat also induces the user to sit on the comfortable inwardly-sloped middle portions 50,51 with legs spread apart and angled upwardly, thus naturally assuming a semi-squat position over the middle portion of a toilet bowl for easy defecation and for optimal hygiene, as illustrated in FIGS. 13,14.

As shown in FIGS. 11,12 buttons 59 support the toilet seat on the top surface of a toilet bowl and lie parallel to the plane of the support surface. It should be noted that the outer peripheral edge of toilet seat 30 may have a different configuration as required by different styles and types of toilets. Toilet seat 30 is somewhat longer and a fraction wider than most conventional regular or elongated toilet seats, as available in the U.S., anno 1978. Any desired hinge means can be employed for attaching seat 30 to a toilet. Any commonly employed materials such as wood, wood compositions, plastics or any other suitable materials can be used for the construction of the seat.

Figure 22:
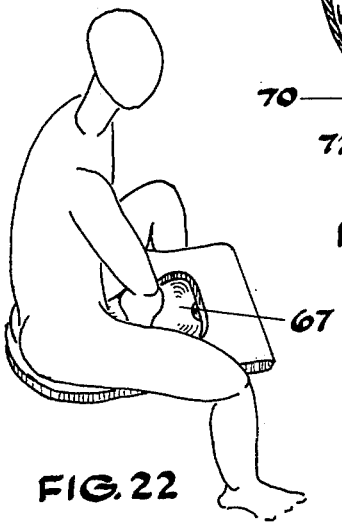
FIG. 22 is a side perspective view illustrating a person seated on the bidet basin as shown in FIG. 21.

Referring now to FIGS. 15-23, bidet basin 32 of FIG. 1A is illustrated with opening 37A of bidet seat portion 33 having an approximate figure-8-shape configuration, defined by enlarged inwardly extended opposite middle portions 63,64 for the support of the user's thighs and defined by relatively narrow opposite front surface areas 81,82 and by relatively narrow opposite rear surface areas 83,84. Arcuate front portion 65 provides a water seal against the buttocks of the user. Enlarged front portion 66 of opening 37A is provided to receive a portion of the user's seat, exposing area 56 of perineum and genitals to the bidet bowl below, bidet bowl portion 34 being integrally connected along its upper edge 35 to the inner peripheral edge 36 of bidet seat portion 33. Enlarged rear portion 67 of opening 37A is provided for the insertion of the user's hand for washing and rinsing of perineum and genitals, as illustrated in FIG. 22.

Figure 16:
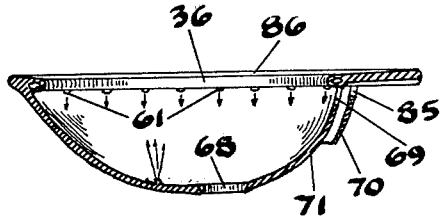
FIG. 16 is a cross-sectional view taken along lines 16—16 of FIG. 15.
Figure 17:
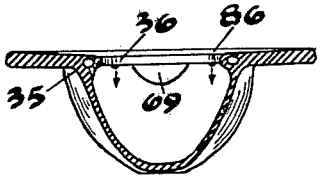
FIG. 17 is a cross-sectional view taken along lines 17—17 of FIG. 15.
Figure 18:
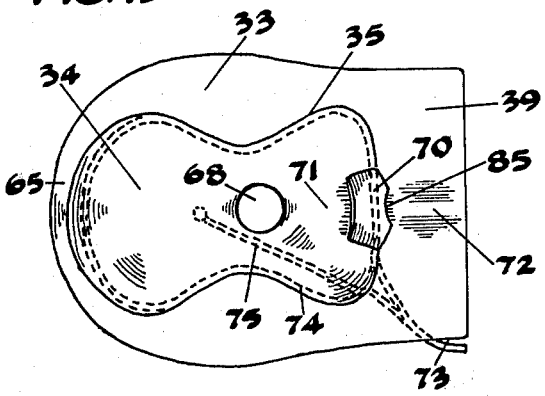
FIG. 18 is a plan view of the bottom side of the bidet basin as shown in FIG. 1A illustrating with dotted lines location of integral water passages formed into the bidet basin.
Figure 23:
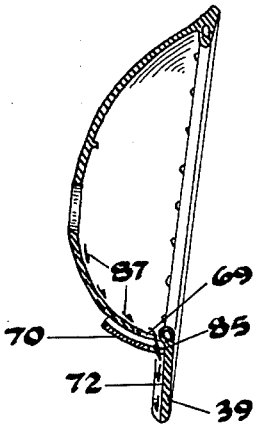
FIG. 23 is a cross-sectional view of FIG. 15 taken along lines 16—16 illustrating the bidet basin in an upwardly pivoted position.
Figure 21:
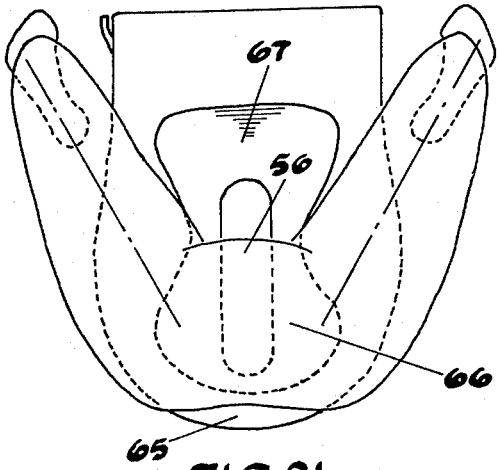
FIG. 21 is a diagramatic plan view illustrating a person seated on the bidet basin of FIG. 15.

The upper surface 86 of bidet seat portion 33 is sloped towards the center opening 37A to allow for water spills to drain back into bidet bowl portion 34, as illustrated in FIGS. 16,17. Bidet bowl portion 34 has a bottom drain opening 68 provided with any convenient means for selectively opening and closing said drain opening. An overflow drain opening 69 is located in the upper rear portion of bidet bowl portion 34 adjacent seat portion 33. A shield 70 is rearwardly spaced over overflow drain opening 69 to direct overflow water along a predetermined path along the underside of rear portion 71 of bidet bowl portion 34. When bidet basin 32 is pivoted upwardly any remaining water drops 87 are directed out through overflow opening 69 and along a carved-out valley 72 on the underside of rear end portion 39, as illustrated in FIG. 23. It should be noted that a gap 85 is provided between the upper edge of shield 70 and the underside of rear end portion 39 to allow the water to pass through.

Two integral water passages 74,75 are provided in bidet basin 32 commencing adjacent rear side edge 73 for connection to flexible water supply conduits. Passage 74 terminates along inner peripheral edge 36 and provides a down-wash 61 into bowl portion 34; passage 75 terminates at the bottom of bidet bowl portion 34 and provides an upspray directed at the perineum of the user.

Any desired hinge means can be employed for attaching bidet basin 32 to a toilet. The bidet basin can also be situated directly over a toilet bowl with an integral toilet seat instead of being situated over a toilet seat. The outer peripheral configuration of the seat portion 33 can be changed to conform to the requirements of different types and models of toilets. Any convenient materials can be used for fabrication. Plastics lend themselves ideally for manufacturing the bidet basin with integral water passages formed therein; plastic feels warm to the touch of skin. However, any other suitable materials can be used.

Figure 20:
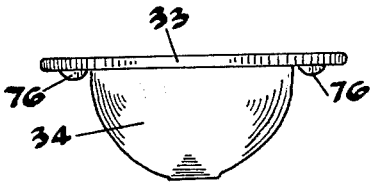
FIG. 20 is a front elevational view of FIG. 15.
Figure 19:
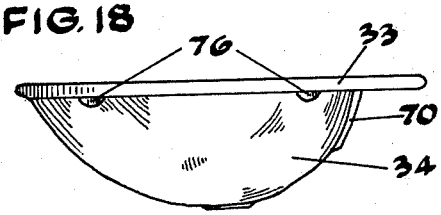
FIG. 19 is a side elevational view of FIG. 15.

As shown in FIGS. 19,20, buttons 76 which support bidet seat portion 33 on the top surface of toilet seat 30 or on a toilet bowl with an integral toilet seat lie in a plane parallel to the top surface supporting them. In conjunction with toilet seat 30 buttons 76 should be located above buttons 59, shown in FIGS. 11,12.

Although an illustrative embodiment of my invention has been described herein with reference to the accompanying drawings, it is to be understood that the invention is not limited to that precise embodiment and that various changes and modifications may be effected therein by one skilled in the art without departing from the scope or spirit of this invention.

What is claimed is:

1. A toilet seat positioned on a toilet bowl, said toilet seat having enlarged inwardly extended opposite middle portions for the supportive engagement of the user's thighs over the middle portion of a toilet bowl, said toilet seat having an opening with an enlarged rear portion and a relatively narrow middle portion defined by said enlarged opposite middle portions; a bidet basin positioned over said toilet seat in lieu of a toilet seat cover, said bidet basin consisting of a bidet seat portion and a bidet bowl portion, said bidet seat portion overlying said toilet seat and said bidet bowl portion being integrally connected along its upper edge to the inner peripheral edge of said bidet seat portion and penetrating said toilet seat opening; said bidet seat portion having enlarged opposite middle portions for the supportive engagement of the user's thighs, said enlarged middle portions of said bidet seat portion overlying said enlarged middle portions of said toilet seat in complementarity; said bidet seat portion having an opening with enlarged rear and front portions and a relatively narrow middle portion, said enlarged rear portion of said bidet seat portion opening overlying said enlarged rear portion of said toilet seat opening in complementarity, said relatively narrow middle portion of said bidet seat portion opening overlying said relatively narrow middle portion of said toilet seat opening in complementarity.

2. A combination as in claim 1 wherein said toilet seat is characterized by a front portion with a relatively narrow surface area and having relatively narrow opposite front surface areas defining an enlarged front portion of said toilet seat opening; said enlarged front portion of said bidet seat portion opening overlying said enlarged front portion of said toilet seat opening in complementarity.

3. A combination as defined in claim 1 wherein said complementary overlying enlarged middle portions of said toilet seat and said bidet seat portion being convexly curved; said complementary enlarged overlying rear portions of said bidet seat portion opening and said toilet seat opening being defined by opposite edge portions being concavely curved; said enlarged front portion of said bidet seat portion opening being defined by inner opposite edge portions being concavely curved.

4. A combination as defined in claim 3 wherein said toilet seat opening having an enlarged front portion defined by a relatively narrow arcuate front portion and by relatively narrow opposite front surface areas having edge portions being concavely curved; said enlarged front portion of said bidet seat portion opening overlying said enlarged front portion of said toilet seat opening in complementarity.

5. A toilet seat and a bidet basin as defined in claim 1 wherein said bidet seat portion having an upper surface being inwardly sloped to allow water spills to drain back into said bidet bowl portion; said bidet bowl portion having a bottom portion and an upper rear edge portion, a drain opening being located in said bottom portion, an overflow drain opening being located in said upper rear edge portion adjacent said bidet seat portion; said bidet basin having two integral water passages formed therein commencing near the rear portion of said bidet seat portion for connection to flexible water supply conduits, one of said water passages terminating along the inner peripheral edge of said bidet seat portion to provide a down-wash into said bidet bowl portion, said other water passage terminating in said bottom portion of said bidet bowl portion to provide an up-spray directed at the perineum of the user.

6. A combination as defined in claim 5 wherein said overflow drain opening having a shield attached exteriorly spaced over said opening, said shield directing overflow water along a predetermined path along the underside of the rear portion of said bidet bowl portion, said shield also providing a gap between its upper edge and the adjacent lower surface area of said rear portion of said bidet seat portion; said lower surface of said rear portion having a valley carved therein to direct the remaining water drops coming through said overflow opening and through said gap along the predetermined path of said valley when said bidet basin has been pivoted into a vertical storage position.

7. A toilet seat and a bidet basin as defined in claim 1 wherein said toilet seat and said overlying bidet seat portion both have rear end portions for the pivotal attachment to a toilet bowl; said bidet seat portion having a rear end portion extending rearwardly beyond the rear end portion of said toilet seat, said bidet seat portion having a pivot axis located rearwardly from the pivot axis of said toilet seat, the rearward shifting of said pivot axis of said bidet seat portion with respect to said pivot axis of said toilet seat permitting the bidet basin to be pivoted upwardly and rearwardly out of the way of said toilet seat opening.

8. A toilet seat and a bidet basin as defined in claim 4 wherein said bidet seat portion and said toilet seat have rear end portions for the pivotal attachment to a toilet bowl; said bidet seat portion having a rear end portion extending rearwardly beyond the rear end portion of said toilet seat, said bidet seat portion having a pivot axis located rearwardly from the pivot axis of said toilet seat; the rearward shifting of the pivot axis of said bidet seat portion with respect to the pivot axis of the toilet seat permitting the bidet basin to be pivoted upwardly and rearwardly out of the way of the opening of said toilet seat; during simultaneous upward and downward movement the vertical distance of said overlying front portions increasing and decreasing due to the shorter pivotal turning radius of said toilet seat forcing the upper inner edge area of the front portion of said toilet seat to move along the underside of said bidet bowl portion; said upper inner edge area of said toilet seat and the contact area of its path along the underside of said front portion of said bidet bowl portion being parallel to each other and being angled at a maximum of 45 degrees with respect to the normal plane of said toilet seat to prevent jamming of said toilet seat into said bidet bowl portion.

9. A bidet basin for permanent connection to a toilet with an integral seat; said bidet basin having a bidet seat portion and a bidet bowl portion, said bidet seat portion overlying a toilet bowl rim, said bidet bowl portion being integrally connected along its upper edge to the inner peripheral edge of said bidet seat portion and being received by a toilet bowl; said bidet seat portion having an opening of an approximate figure-8-shape configuration defined by enlarged front and rear portions and a relatively narrow middle portion; said bidet seat portion having two opposite enlarged middle portions for the supportive engagement of the user's thighs and a front portion defining said enlarged front portion of said opening; the user straddling said bidet seat portion facing to the rear with the perineum and genitals suspended over the middle and front portions of said bidet bowl portion, the seat of the user being located over said enlarged front portion of said opening, said front portion of said seat portion providing a water seal against the underside of the buttocks of the user; said enlarged rear portion of said opening being provided for the insertion of the user's hands for washing and rinsing purposes.

10. A bidet basin as defined in claim 9 wherein the upper surface of said bidet seat portion being inwardly sloped to allow water spills to drain back into said opening; said bidet bowl portion having a bottom portion and an upper rear edge portion, a drain opening being located in said bottom portion, an overflow drain opening being located in said upper rear edge portion adjacent said bidet seat portion; said bidet basin having two integral water passages formed therein commencing near the rear portion of said bidet seat portion for connection to flexible water supply conduits, one of said water passages terminating along the inner peripheral edge of said bidet seat portion to provide a down-wash into said bidet bowl portion, said other water passage terminating in said bottom portion of said bidet bowl portion to provide an up-spray directed at the perineum of the seated user.

11. A bidet basin as defined in claim 10 wherein said overflow drain opening having a shield attached exteriorly spaced over said opening, said shield directing water overflowing through said opening along a predetermined path along the underside of the rear portion of said bidet bowl portion; said shield also providing a gap between its upper edge and the adjacent lower surface area of said rear portion of said bidet seat portion, said lower surface area having a valley carved therein to direct remaining water drops coming through said overflow drain opening and through said gap along a predetermined path of said valley when said bidet basin has been pivoted into a vertical storage position.

* * * * *